United States Patent [19]

Hamajima et al.

[11] Patent Number: 4,712,600

[45] Date of Patent: Dec. 15, 1987

[54] PRODUCTION OF PISTONS HAVING A CAVITY

[75] Inventors: Kaneo Hamajima, Nagoya; Tadashi Dohnomoto, Toyota; Atsuo Tanaka, Toyota; Masahiro Kubo, Toyota, all of Japan

[73] Assignee: Toyota Jidosha Kabushiki Kaisha, Toyota, Japan

[21] Appl. No.: 883,825

[22] Filed: Jul. 9, 1986

[30] Foreign Application Priority Data

Jul. 12, 1985 [JP] Japan ..... 60-153640
Jul. 22, 1985 [JP] Japan ..... 60-161377
Jul. 25, 1985 [JP] Japan ..... 60-164822

[51] Int. Cl.[4] ..... B22D 18/02; B22D 19/00; B22D 19/14; B22D 29/00

[52] U.S. Cl. ..... 164/97; 164/98; 164/108; 164/110; 164/120; 164/132

[58] Field of Search ..... 164/97, 98, 108, 109, 164/110, 120, 132

[56] References Cited

U.S. PATENT DOCUMENTS 4,570,693 2/1986 Barlow ..... 164/120 X
4,573,519 3/1986 Donomoto et al. ..... 164/120 X
4,651,631 3/1987 Avezou ..... 164/97 X

FOREIGN PATENT DOCUMENTS 2123727A 2/1984 United Kingdom ..... 164/98

*Primary Examiner*—Nicholas P. Godici
*Assistant Examiner*—J. Reed Batten, Jr.
*Attorney, Agent, or Firm*—Oblon, Fisher, Spivak, McClelland & Maier

[57] ABSTRACT

A piston of a light alloy matrix material having a cavity for containing heat insulating air immediately below its head or a cavity for passing cooling oil inside the grooved side wall is manufactured by preforming a precursory member having the shape of the cavity from an extractable material which remains in solid state at room temperature and is convertible into a fluid, gas or liquid when heated at a temperature below the melting point of the matrix metal. The precursory member is disposed in place in a pressure casting mold having a cavity corresponding to the shape of the piston, and covered with a porous member stable to the molten matrix metal. A head member of heat resisting metal material to constitute at least a portion of the piston head may be disposed on the mold cavity bottom. Molten matrix metal is then cast into the mold cavity and a pressure is applied thereto to form a piston-shaped casting having precursory member and porous member embedded therein. Finally the casting is heated at a sufficient temperature to gasify or liquefy the extractable material of the precursory member material into fluid, which is extracted from the casting, leaving a cavity at the location of the precursory member. Alternatively, the precursory member may be formed from a composite material of a gasifiable material and a stable material whereby the cavity is given as a porous insert of the stable material which is left after the extraction of the gasifiable material by heating.

24 Claims, 49 Drawing Figures

PRODUCTION OF PISTONS HAVING A CAVITY

BACKGROUND OF THE INVENTION

This invention relates to pistons made of light alloys such as aluminum alloys as the matrix metal and finding utility in diesel engines for automobiles, and more particularly, to pistons having a cavity for air heat insulation or other purposes within their head.

Most of pistons currently used in advanced engines are those cast from light alloys as exemplified by aluminum alloys for the main purpose of achieving a weight reduction to reduce the inertia force of reciprocating parts. Since aluminum alloy, however, has a high thermal conductivity, an engine having pistons of aluminum alloy has the problem that a substantial amount of the heat generated in the combustion chamber by the combustion of fuel is conducted outside the combustion chamber through the pistons and the thermal efficiency of the engine is accordingly reduced. This results in reductions of fuel consumption and power, while leaving a risk of incomplete combustion at an initial period from the start. In recently developed engines having aluminum alloy pistons mounted, particularly diesel engines, attempts of preventing leakage of heat from the combustion chamber through the pistons by providing a piston head of heat insulating structure were made for the purposes of keeping the combustion chamber at higher temperatures to improve fuel consumption and power and preventing incomplete combustion at an initial period from the start.

One of known effective means for rendering the piston head heat insulating is to form immediately below the piston head a hollow space or cavity for containing heat insulating air. To accommodate an increase of the head temperature due to heat insulation, the head is formed from heat resistant material. More particularly, a head member formed from a heat resistant material such as a superalloy, typically Inconel is fastened to a piston body by bolts or the like while providing a cavity therebetween. This technique requires a previous step of forming holes and threads in the head member and the piston body as by machining in addition to the bolting step, and thus leads to low productivity and increased cost. There also arises a problem during the operation of the piston that the piston body, particularly at the site of bolt holes undergoes creep deformation, losing the effective bond strength between the heat resistant material head member and the body.

There is a great need for the development of a method for producing a piston having a cavity for heat insulation just below its head without the problems of cost increase and productivity decline. One method believed effective for such purposes is the application of an insert embedded casting process wherein matrix metal is cast into a piston body in which a head member of heat resistant material is incorporated as an insert while a cavity is left immediately below the head member. The effective casting processes used herein are pressure casting processes including so called high pressure casting process because casting of matrix metal with an insert embedded is facilitated and because little defects are introduced and a finer grain structure is achieved in the resulting piston body.

In most commonly used methods for creating a cavity within a casting, a casting having a sand core such as a shell core inserted therein is first formed and the sand core is then removed from within the casting. Alternative methods commonly used are by casting a part using a core of a material capable of being readily dissolved in such a solvent as water, for example, a salt core, and removing the core by dissolving away after the casting.

When a high pressure casting process is applied to cast molten metal using a sand core, the molten metal is infiltrated into the core by the high pressure applied thereto, making it difficult to remove the core sand from within the casting. A similar problem occurs with the use of salt cores. Compression molded salt cores can be impregnated with molten metal during high pressure casting. Salt cores solidified from a metal tend to develop cracks during high pressure casting.

It was thus very difficult in the prior art to form a cavity of any desired shape within a casting by pressure casting processes such as high pressure casting.

The air heat insulation layer to be formed immediately below the heat resistant material head member of a piston may be provided by a porous heat insulating layer containing a plurality of fine pores as well as the above-mentioned cavity. As opposed to the insulating layer in the form of a whole cavity, the provision of a cellular heat insulating layer in the form of a porous body is effective in preventing the heat resistant material head member from deforming under combustion pressures. This, in turn, allows the use of a thinner head member which leads to a reduction of piston weight, probably contributing to some improvements in engine performance and fuel consumption.

Prior art methods for forming a porous portion within a casting involve embedding hollow spheres such as shirasu baloons or inserting a porous body such as a shell core during casting.

If the above-mentioned formation of a porous portion within a casting by embedding hollow spheres therein is combined with the high pressure casting process, the hollow spheres are ruptured by the pressure applied to the molten matrix metal, failing to form the porous portion having the desired porosity. As for the method of directly inserting a porous body in a casting, the porous body is impregnated with the molten matrix metal under pressure to form an impregnated body having low heat insulation.

It was thus very difficult in the prior art to form a porous portion for air heat insulation having any desired shape and porosity and free of any impregnating matrix metal within a casting by pressure casting processes.

In pistons of aluminum alloy, it has been a common practice to provide a cavity or porous portion inside the side wall of the piston where piston ring grooves are formed. This cavity or porous portion serves as a cooling channel or oil gallery to cool the grooved side wall with cooling oil from the inside for the purpose of improving the wear resistance of the grooved side wall. The same discussion as above is applicable to the formation of such a cooling oil channel.

SUMMARY OF THE INVENTION

An object of the present invention is to provide a novel and improved method for making a piston of a light alloy matrix material having a cavity within its head by a pressure casting process in a practically acceptable manner without inviting the above-mentioned problems.

Another object of the present invention is to provide a method for making a piston having a cavity contained therein as an air heat insulation by pressure casting.

A further object of the present invention is to provide a method for making a piston having a porous insert contained therein as an air heat insulation by pressure casting.

A further object of the present invention is to provide a method for making a piston having a cavity for passing cooling oil inside the side wall of the piston where piston ring grooves are formed.

A still further object of the present invention is to provide a method for making a piston having an air heat insulation wherein a region surrounding the air heat insulation is comprised of a reinforced composite material.

The term cavity used in connection with the piston or piston head is intended to encompass any hollow spaces including wholly empty chambers and porous, cellular, reticulated bodies which are considered as an assembly of fine open cells.

A first embodiment of the present invention is directed to a method for producing a piston having a wholly empty cavity. That is, the first embodiment provides a method for producing a piston of a light alloy matrix material having a cavity within its head by pressure casting, comprising the steps of preforming a precursory member having the shape of the cavity from an extractable material which remains in solid state at room temperature and is convertible into a fluid at a heating temperature below the melting point of the matrix metal, disposing the precursory member in place in a pressure casting mold having a cavity corresponding to the shape of the piston, while covering the precursory member with a porous member stable to molten matrix metal, pouring molten matrix metal into the mold cavity and applying a pressure thereto to form a piston-shaped casting having the precursory member and the porous member embedded therein, and heating the casting at a temperature below the melting point of the matrix metal and above the fluidizing temperature of the material of the precursory member to convert the precursory member material into a fluid, and extracting the fluid from the casting, leaving a cavity at the location of the precursory member.

The extractable material from which the precursory member is formed may include materials which can be gasified at a heating temperature below the melting point of the matrix metal (to be referred to as gasifiable materials, hereinafter) and materials which can be melted at a heating temperature below the melting point of the matrix metal (to be referred to as low melting materials, hereinafter). The former materials may be gasified through combustion, sublimation, evaporation, or decomposition when heated. When the gasifiable material is used, the precursory member made thereof is removed by gasification during the heating step after the pressure casting. The area where the precursory member has been located now becomes a cavity. In the case of the low melting material, the precursory member is removed by melting during the heating step after the pressure casting, also leaving a hollow space or cavity.

In the first embodiment, a precursory member is preformed to the geometrical shape of the cavity from an extractable solid material which remains in solid state at room temperature and is gasifiable or liquefiable at a heating temperature below the melting point of the matrix metal. The precursory member is disposed in place in a pressure casting mold having a cavity corresponding to the shape of the piston while it is covered with a porous member which is stable to the molten matrix metal. Molten matrix metal, for example, molten aluminum alloy is then poured into the mold cavity, followed by pressure casting.

If molten matrix metal at a high temperature is poured in the mold cavity without covering the precursory member with the porous member, the material of the precursory member experiences a rapid temperature rise due to contact with the molten matrix metal and is thus rapidly gasified or melted. If the material of the precursory member is gasified immediately after pouring of molten metal, the resulting gases would disperse into the molten metal to cause defects such as blow holes and shrinkage cavities. Also the gasified material would not maintain its shape, failing to obtain a cavity of the desired shape in the final cast product. If the material of the precursory member is melted immediately after pouring of molten metal, the molten material would disperse into the molten metal. This not only fails to form a cavity, but also adversely affects various properties of the matrix metal, for example, mechanical strength. Nevertheless, the method of the present invention involves covering the precursory member with the porous member to prevent the molten matrix metal being poured from directly and immediately contacting the precursory member. As the molten matrix metal is forced under pressure, it infiltrates the porous member and penetrates therethrough over a certain time. That is, the precursory member is contacted by molten matrix metal after the molten metal has penetrated through the porous member. Since the molten matrix metal does not directly contact the precursory member at the time of pouring and since the porous member interposed between the molten metal and the precursory member has great heat insulation because of its porosity, the temperature of the precursory member is not so increased during pouring and hence, the extractable material of the precursory member is prevented from premature gasification by combustion, sublimation, evaporation or decomposition or premature melting. It might happen that the application of pressing force causes the molten metal to penetrate through pores of the porous member to reach the precursory member as mentioned above. Normally, however, the molten metal is rapidly cooled and solidified in the pressure casting, particularly high pressure casting because the pressing force ensures a very close contact between the molten metal and the mold surface. Then, even if gases are generated at contact sites between the molten metal and the precursory member, the gases could not disperse into the matrix metal, inducing no defects in the casting. Also, even if the material of the precursory member is melted at such contact sites, the molten material would not disperse into the matrix metal, and deterioration of properties of the matrix metal is thus prevented. Fast cooling of the molten matrix metal due to pressure casting as mentioned above is advantageous in that even if the molten metal penetrates through the porous member to reach the precursory member, the duration when the material of the precursory member is kept at a temperature above its gasifying or melting temperature is a very short time. There is thus formed a relatively small amount of gas or liquid at contact sites, which also contributes to controlling the occurrence of casting defects and the deterioration of matrix metal properties. Since only a minimal amount of molten matrix metal can penetrate through the porous member up to the precursory member as a result of quick cooling and freezing of molten metal, that region to be eventually converted into a cavity substantially maintains its geometrical shape.

After pressure casting under the aforementioned conditions, the cast product is taken out of the mold and then heated at a temperature below the melting point of the matrix metal and above the gasifying or melting temperature of the extractable material of the precursory member. The material is thus gasified through combustion, sublimation, evaporation or decomposition into gases which flow out of the casting through a preformed vent passage, or melted into a liquid which flows out of the casting through the passage. In either case, there is left a cavity at the region where the precursory member has been located. The passage for material removal may generally be formed by drilling a hole extending from the outside of the casting remote from the piston head to the precursory member after the casting step and before the heating step.

In this way, there is obtained a piston casting in which a cavity substantially conforming to the shape and dimensions of the precursory member is located at the region where the precursory member is located at the time of casting. The porous member with which the precursory member has been covered is now converted into a composite region in which the porous material is combined with the matrix metal. This composite region has high physical strengths because of its porous material-matrix metal integration and encloses the cavity. The reinforced structure surrounding the cavity contributes to the improved durability of the piston.

It will be understood to those skilled in the art that the step of removing the precursory member by heating it to gasify the material through combustion, sublimation, evaporation or decomposition, or melt the material into a fluid to be extracted may be combined with a heat treatment usually applied to the casting. Illustratively, in the case of a piston casting of aluminum alloy, for example, it is a common practice to subject the casting to a so-called T7 treatment wherein a solution heat treatment is followed by hardening and subsequent stabilizing. This treatment can also serve for the removal of the precursory member through its gasification or liquefaction. Thus, no special heating step is necessary for the removal of the precursory member.

Particularly when it is desired to manufacture a piston having a heat insulating cavity immediately below the head surface, the disposing step is modified. A head member of heat resisting metal material to constitute at least a portion of the piston head is first disposed on the bottom of the pressure casting mold cavity, the precursory member then placed on the inside of the head member, and the porous member stable to molten matrix metal placed thereon to cover the precursory member. With this modification, there is finally obtained a piston in which the head surface is defined by the heat resistant metal member and a cavity for containing heat insulating air is defined immediately below the head surface.

A second embodiment of the present invention is directed to a method for producing a piston having a cavity in the form of a porous insert. That is, the second embodiment provides a method for producing a piston of a light alloy matrix material having a cellular cavity within its head by pressure casting, comprising the steps of preforming a precursory member having the shape of the cellular cavity from a composite material comprising a normally solid material which remains in solid state at room temperature and is gasifiable at a heating temperature below the melting point of the matrix metal and a material integrated therewith and stable at least at the gasifying temperature of the normally solid material, disposing the precursory member in place in a pressure casting mold having a cavity corresponding to the shape of the piston, while covering the precursory member with a porous member stable to molten matrix metal, pouring molten matrix metal into the mold cavity and applying a pressure thereto to form a piston-shaped casting having the precursory member and the porous member embedded therein, and heating the casting at a temperature below the melting point of the matrix metal and above the gasifying temperature of the normally solid material of the precursory member to gasify the normally solid material, and extracting the resulting gases from the casting, thereby converting the precursory member into a cellular cavity.

The method according to the second embodiment uses a precursory member for eventually defining a cellular cavity or porous insert. The precursory member is formed from a composite material comprising (1) a normally solid material which remains in solid state at room temperature and is gasifiable at a heating temperature below the melting point of the matrix metal and (2) a stable material which is stable at least at the gasifying temperature of the normally solid material, the normally solid material and the stable material being physically combined and integrated. The precursory member is configured to the geometrical shape of the cellular cavity to be finally formed. The precursory member or shaped composite material is covered with a porous member of a material stable to molten matrix metal and then placed in the mold into which molten matrix metal, for example, molten aluminum alloy is poured for pressure casting.

If molten matrix metal at a high temperature is poured in the mold cavity without covering the precursory member with the porous member, the material of the precursory member experiences a rapid temperature rise due to contact with the molten metal and the normally solid material moiety is thus rapidly gasified through combustion, sublimation, evaporation or decomposition. The gasified material would disperse into the molten metal to cause defects such as blow holes and shrinkage cavities. Also the molten metal would enter the vacancy where the normally solid material has disappeared through gasification, and the precursory member would not maintain its shape due to the pressure applied to the molten metal, failing to obtain a ceallular cavity of the desired shape and heat insulating capacity in the final cast product. Nevertheless, the method of the present invention involves covering the precursory member with the porous member to prevent the molten matrix metal being poured from directly and immediately contacting the precursory member. As the molten metal is forced under pressure, it infiltrates the porous member and penetrates therethrough over a certain time. That is, the precursory member is contacted by molten matrix metal after the molten metal has penetrated through the porous member. Since the molten metal does not directly contact the precursory member at the time of pouring and since the porous member interposed between the molten metal and the precursory member has great heat insulation because of its porosity, the temperature of the precursory member is not so increased during pouring and hence, the normally solid material of the precursory member composite material is prevented from premature gasification by combustion, sublimation, evaporation or decomposition. It might happen that the application of pressing force causes the molten metal to penetrate through pores of the porous member to reach the precursory member as mentioned above. Normally, however, the molten metal is rapidly cooled and solidified in the pressure casting, particularly high pressure casting because the pressing force ensures a very close contact between the molten metal and the mold surface. Then, even if gases are generated at contact sites between the molten metal and the precursory member, the gases could not disperse into the matrix metal, inducing no defects in the casting. Fast cooling of the molten matrix metal due to pressure casting as mentioned above is advantageous in that even if the molten metal penetrates through the porous member to reach the precursory member, the duration when the normally solid material of the precursory member composite material is kept at a temperature above its gasifying temperature is very short. There is thus formed a relatively small amount of gases at contact sites, which also contributes to controlling the occurrence of casting defects and the deterioration of matrix metal properties. Since only a minimal amount of molten matrix metal can penetrate through the porous member up to the precursory member as a result of quick cooling and freezing of molten metal, the composite material is little infiltrated with the molten metal. This in turn means that the cellular cavity which results from the composite material precursory member contains little matrix metal and possesses a sufficient heat insulating or oil receiving capacity. The composite material maintains its geometrical shape against the molten metal pressure with the aid of the covering porous member, and hence, that region to be eventually converted into a cellular cavity substantially maintains its geometrical shape.

After pressure casting under the aforementioned conditions, the cast product is taken out of the mold and then heated at a temperature below the melting point of the matrix metal and above the gasifying temperature of the normally solid material of the precursory member. The material is thus gasified through combustion, sublimation, evaporation or decomposition into gases which flow out of the casting through a preformed vent passage. The region where the normally solid material has occupied now becomes vacant. The composite material becomes a porous material, that is, the precursory member is converted into a porous insert or cellular cavity for containing heat insulating air or passing cooling oil.

In this way, there is obtained a piston casting in which a cellular cavity substantially conforming to the shape and dimensions of the precursory member is located at the region where the precursory member is located at the time of casting. The porous member with which the precursory member has been covered is now converted into a composite region in which the porous material is combined with the matrix metal. This composite region has high physical strengths because of its porous material-matrix metal integration and encloses the cellular cavity. The reinforced structure surrounding the cellular cavity contributes to the improved durability of the piston.

As in the first embodiment, the final step of removing the normally solid material through combustion, sublimation, evaporation or decomposition may be accomplished by a requisite heat treatment to be applied to the casting.

Particularly when it is desired in the second embodiment to manufacture a piston having a heat insulating cellular cavity immediately below the head surface, the disposing step is modified as described for the first embodiment. A head member of heat resisting metal material to constitute at least a portion of the piston head is first disposed on the bottom of the pressure casting mold cavity, the precursory member then placed on the inside of the head member, and the porous member stable to molten matrix metal placed thereon to cover the precursory member. With this modification, there is finally obtained a piston in which the head surface is defined by the heat resistant metal member and a cellular cavity for containing heat insulating air is defined immediately below the head surface.

BRIEF DESCRIPTION OF THE DRAWINGS

In order that those skilled in the art will better understand the practice of the method of the present invention, the invention is described in further detail by referring to the accompanying drawings, in which.

DETAILED DESCRIPTION OF THE INVENTION

Figure 1:
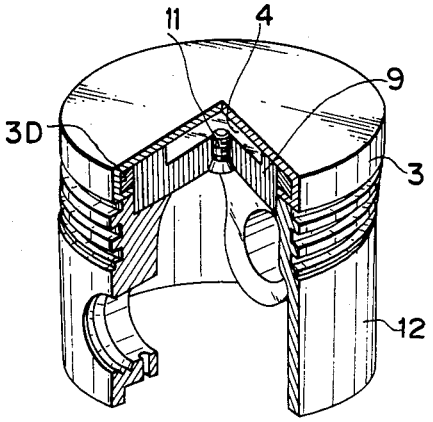
FIG. 1 is a perspective, partially cut away, view of one example of the heat insulating piston manufactured by the method of one embodiment of the present invention.

The first embodiment of the present invention will now be detailed by referring to the manufacture of a heat insulating piston having an empty cavity for containing heat insulating air as shown in FIG. 1.

Figure 2:
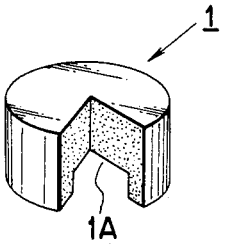
FIG. 2 is a perspective, partially cut away, view of a porous member used in the manufacture of the piston of FIG. 1.
Figure 3:
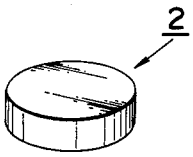
FIG. 3 is a perspective view of a precursory member used in the manufacture of the piston of FIG. 1.
Figure 4:
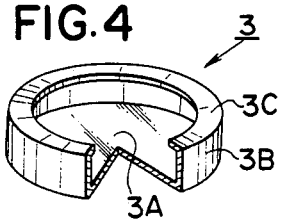
FIG. 4 is a perspective, partially cut away, view of a head member used in the manufacture of the piston of FIG. 1.
Figure 5:
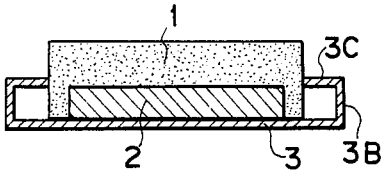
FIG. 5 is a cross sectional view of an assembly of the members of FIGS. 2, 3, and 4.

A heat insulting piston as shown in FIG. 1 is manufactured by previously preparing a porous member 1, a precursory member 2, and a head member 3 of a heat resisting metal material as shown in FIGS. 2, 3, and 4, respectively, and then combining them into an assembly as shown in FIG. 5.

The precursory member 2 is a member for defining a heat insulating air fill space. It may be formed from a gasifiable material which remains in solid state approximately at room temperature and is convertible into gases through combustion, sublimation, evaporation or decomposition when heated at a temperature below the melting point of a matrix material to be cast, for example, aluminum alloy. The gasifiable materials may be either organic or inorganic materials. Examples of the gasifiable organic materials include synthetic resins such as epoxy resins and acrylic resins; wood; mixtures of wood and resins such as resin impregnated wood chips and compacts of resin and wood dust; and rubbers such as silicone rubbers. Examples of the gasifiable inorganic materials are selenium dioxide, tin tetrabromide, etc. The gasifiable materials which may be used to form the precursory member are not limited to these examples.

The precursory member 2 may also be formed from a low melting material which remains in solid state approximately at room temperature and can be melted when heated at a temperature below the melting point of a matrix metal to be cast, for example, aluminum alloy. The low melting materials include low melting metals and alloys, thermoplastic resins, and inorganic compounds.

Where a heat insulating piston is manufactured from an aluminum alloy as a casting matrix material, it is desired that the low melting material not only have a melting point lower than that of the aluminum alloy, but also melt at a temperature below the temperature of a solution heat treatment to be effected after casting. In this respect, lead (Pb, melting point about 327° C.) and lead alloys are the preferred low melting materials. Examples of the lead alloys having a melting temperature below the temperature of a solution heat treatment to be effected on the aluminum alloy include bearing alloys including nine types as specified by JIS Japanese Industrial Standard) and designated WJ9, soldering alloys including four types of hard lead alloys as specified by JIS and designated HPb4, and type metals such as type metal ingot, type 1, No. 1 as specified by JIS. For aluminum alloy castings, use may also be made of metals having a melting point lower than the aluminum alloys, for example, sodium Na, bismuth Bi, tin Sn, zinc Zn, etc. and thermoplastic resins such as polycarbonates and polybutylene terephthalate (PBT).

Where it is necessary to maintain the precise shape of the cavity, the low melting materials should preferably be thermoplastic resins and inorganic compounds which would melt without reacting with the matrix metal. Also useful are metals which would be present in liquid state as a separate phase from the co-existing matrix metal and thus form little solid solution with the matrix metal. For the matrix metal of aluminum, the useful metals are lead, bismuth, cadmium, indium, and sodium, for example.

The precursory member 2 made of such a gasifiable or low melting material is of a geometrical shape corresponding to a cavity 4 (see FIG. 1) to be finally defined, for example, of a disk shape.

The porous member 1 is formed of a material which is stable to the molten matrix metal to be cast, for example, molten aluminum alloy, preferably a material having a higher melting point than the pouring temperature of the molten metal. The porous member 1 desirably has a sufficiently low thermal conductivity to minimize the temperature rise of the precursory member upon pouring of the molten metal. In this respect, ceramic porous bodies, for example, moldings of short fibers of alumina and silicon nitride are preferred as well as metallic porous bodies such as moldings of stainless steel fibers although the porous materials are not limited to them. The porous member is used for the main purpose of preventing the molten matrix metal from directly contacting the precursory member in solid state upon pouring thereof. In this respect, the porous member is desired to have a packing density of at least 5%. Since too higher packing densities make it difficult to integrate the porous member with the matrix metal, the upper limit of packing density is 60%. The porous member 1 is previously fabricated in a shape to cover the precursory member 2. Entire coverage of the outer surfaces of the precursory member 2 is not necessary. It is only required to cover the precursory member 2 such that the molten metal may not directly contact the precursory member 2 upon pouring. More particularly, in manufacturing the heat insulating piston shown in FIG. 1, since one surface (lower surface in FIG. 5) of the precursory member 2 that is in contact with the head member 3 of heat resisting metal and thus covered therewith is prevented from the contact with the molten matrix metal, it suffices that the porous member 1 covers the remaining surfaces of the precursory member 2. That is, the porous member 1 may be provided with a disk-shaped recess 1A which mates with the precursory member 2.

The head member 3 is a member which finally forms the head of the piston. It may be formed of any heat resisting metals, for example, stainless steels such as SUS 304, heat resisting steels of the JIS SUH series, heat resisting iron base alloys or iron base superalloys such as Incoloy, heat resisting nickel base alloys or nickel base superalloys such as Inconel, heat resisting cobalt base alloys or cobalt base superalloys such as Nivco, and cast steels of the JIS SCH series. In the illustrated example of FIGS. 4 and 5, the head member 3 is configured by bending a circumferential portion 3B of a disk substantially at right angles to define a recess 3A, and further folding inward an outer edge portion 3C of the once-folded cylindrical portion 3B substantially at right angles, for example, by a hydraulic forming technique. The precursory member 2 and the porous member 1 are placed on the bottom of the recess 3A of the thus configured head member 3 such that the lower surface of the precursory member 2 is in close contact with the bottom surface of the head member and the porous member 1 receives the precursory member 2 in its recess 1A to completely cover the precursory member.

Figure 6:
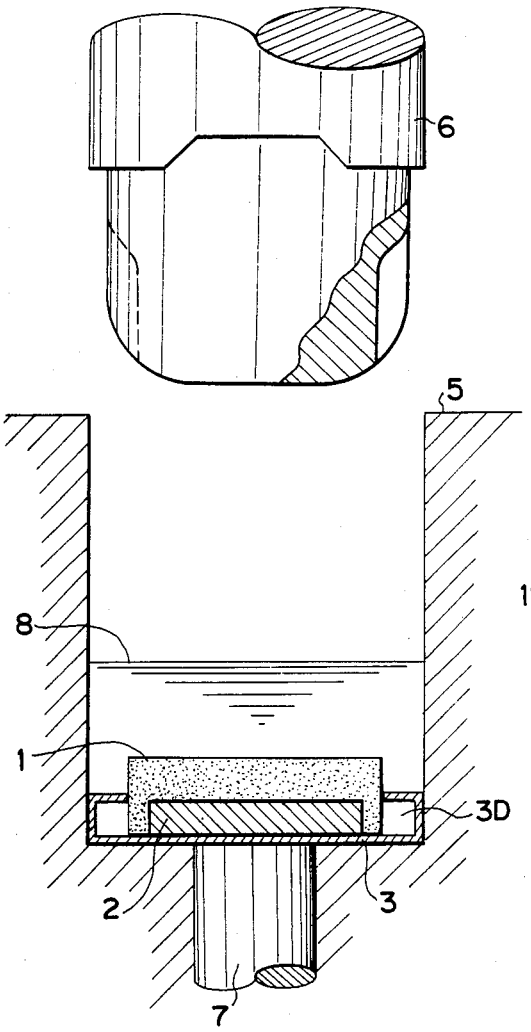
FIG. 6 schematically illustrates the pouring of molten matrix metal into a mold in the manufacture of the piston of FIG. 1.

The assembly of the thus combined porous member 1, precursory member 2, and head member 3 is then disposed in place in a cavity of a pressure casting mold 5, for example, a high pressure casting mold as shown in FIG. 6. The mold 5 has a cavity whose shape conforms to the intended piston. The assembly or the head member 3 thus closely fits in the mold cavity. A forcing punch 6 which cooperates with the mold 5 is located above the mold. The mold 5 is provided with a knock-out pin 7 at the cavity bottom for removing the molded product from the cavity.

Then a melt 8 of casting matrix metal, for example, molten aluminum alloy is poured into the mold cavity. Since the molten matrix metal 8 does not come in direct contact the precursory member 2 upon pouring as previously described, the material of which the precursory member 2 is made does never gasify through combustion, sublimation, evaporation or decomposition or melt at this point of time.

Thereafter, the molten matrix metal 8 is forced by the punch 6 to cause the molten metal to infiltrate into the porous member 1 under pressure to form a composite region 9. At this point of time, the molten metal 8 which has penetrated through pores of the porous member 1 emerges from the porous member 1 to contact the precursory member 2 covered with the porous member. The material of the precursory member 2 can thus be partially gasified or melted at contact sites. However, the rapid cooling and solidification of the molten matrix metal 8 with the aid of the pressing force as previously described prohibits dispersion of evolving gases or diffusion of melted material into the casting matrix metal, preventing occurrence of casting defects and deterioration of matrix metal properties. The magnitude of the pressing force is not particularly limited although it is preferably at least about 300 kg/cm$^2$ in order to prevent occurrence of shrinkage cavity, make the cast structure finer, achieve a close contact between the mold 6 and the molten metal 8 to promote rapid cooling and solidification, and fully infiltrate the porous member 1 with the molten metal 8. The pressure casting techniques employed herein may be well known pressure die casting as well as pressure casting using a punch for the application of pressure. Depending on the shape of the intended casting, a centrifugal casting technique may also be used. In either case, the pressing force must be maintained until the molten metal 8 has completed solidification.

Figure 7:
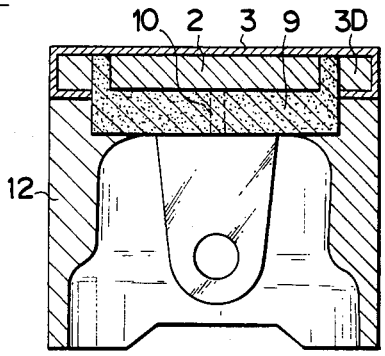
FIG. 7 is an axial cross-sectional view of an as-cast piston before the precursory member is removed.

The solidified piston casting is taken out of the mold 5. FIG. 7 shows the casting in which the porous member 1 has formed a composite region 9 with the matrix metal and which has the precursory member 2 and the head member 3 embedded in the solidified matrix metal 12, for example, aluminum alloy.

The piston casting is then perforated with a passage 10 which extends throughout the composite region 9 in communication with the precursory member 2 before the casting is heated at a temperature below the melting point of the matrix metal and above the gasifying temperature (that is, combustion, sublimation, evaporation, or decomposition temperature) or melting point of the material of the precursory member 2. Then the material of the precursory member 2 is gasified or melted to flow away through the passage 10, leaving a cavity 4. Thereafter, the casting may be machined if necessary and the passage 10 is closed with a plug, for example, a screw 11, obtaining a heat insulating piston as shown in FIG. 1.

When automotive pistons are manufactured by aluminum alloy casting, it is a common practice to effect a T7 treatment at the end of casting. Since the heat applied in the T7 treatment is sufficient to extract the material of the precursory member 2 through gasification or melting, any particular heating other than the T7 treatment is not necessary for material removal.

In the thus manufactured heat insulating piston as shown in FIG. 1, the head is constituted by the head member 3 of heat resistant metal, the cavity 4 is defined immediately below the head for containing heat insulating air, and the peripheral and lower sides of the space 4 are reinforced by the metal/porous material composite region 9.

It will be understood that the molten matrix metal 8 penetrates through the porous member 1 to enter a region 3D defined by the peripheral folded portions 3B and 3C of the head member 3. The head member 3 is firmly supported in the region 3D too.

Although the foregoing description is made in connection with the manufacture of a piston having a heat insulating cavity immediately below its head surface, the first embodiment of the present method may also be applied to the manufacture of pistons having a cavity for other purposes. In general, pistons of aluminum alloy have the likelihood that the side wall having formed grooves in which piston rings are fitted becomes less wear resistant at elevated temperatures during engine operation. By forming inside the grooved side wall a circumferentially extending channel for passing cooling oil, the side wall may be cooled with the oil to improve the wear resistance thereof. The present method is applicable to such pistons. In forming a cavity for passing cooling oil, the head member used in the foregoing embodiment is unnecessary. The precursory member having the shape of the cavity is entirely covered with a porous member and placed in the mold. Holes drilled in the casting for extracting the gasified or liquefied material of the precursory member may be used as inlet and outlet ports for the passage of cooling oil, and thus they need not be plugged after drainage of the precursory member material.

EXAMPLE 1

A heat insulating piston as shown in FIG. 1 was manufactured by preparing a porous member 1, a precursory member 2, and a head member 3 having shapes as shown in FIGS. 2 to 4. The porous member 1 was molded from alumina short fibers to a bulk density of 0.17 g/cm$^3$ and dimensioned to an outer diameter of 70.2 mm, an entire thickness of 30 mm, a recess 1A diameter of 60 mm, and a recess 1A depth of 10 mm. The precursory member 2 was made from an epoxy resin extractable through gasification and dimensioned to a diameter of 60 mm and a thickness of 10 mm. The head member 3 was prepared from an SUS 304 stainless steel strip of 4 mm thick by hydraulic forming and dimensioned to an outer diameter of 83 mm, a height of 15 mm, and a peripheral portion 3C opening diameter of 70 mm.

These members were combined into an assembly as shown in FIG. 5. The assembly was placed in a mold 5 as shown in FIG. 6. A melt 8 of an aluminum alloy (JIS AC8A, Al-12%Si-1.2%Cu-1.0%Mg-2%Ni-0.3%Fe) at a temperature of 720° C. was cast into the mold cavity, and then forced under a pressure of 500 kg/cm$^2$ by a pressing punch 6 to accomplish high pressure casting. The pressing force was maintained until the molten aluminum alloy had completely solidified. After solidification, the casting was taken out of the mold and machined to form a vent or passage 10 having a diameter of 3 mm for gas venting as shown in FIG. 7. The casting was subjected to a T7 heat treatment includihg a solution heat treatment at 490° C. for 4 hours and an aging treatment at 220° C. for 8 hours. The heat treated casting was observed to find that the epoxy resin of the precursory member had been completely decomposed and gasified and that a cavity 4 substantially conforming to the original shape and dimensions of the extracted precursory member was left within the piston body.

The casting was then machined to a piston contour and the passage 10 was plugged with a stainless steel screw 11, finally obtaining a heat insulating piston as shown in FIG. 1.

A series of pistons were manufactured by the same procedure under the same conditions as above using instead of the epoxy resin, a wood piece impregnated with polyester resin, a compact of wood dust and phenol resin, and a silicone rubber as the precursory member. These attempts were successful in obtaining hollow spaced pistons of substantially the same quality, dimension, and shape as above. When precursory members made of $SeO_2$ and $SnBr_4$ were used instead of the epoxy resin precursory member, it was found that the former sublimated and the latter evaporated during the T7 heat treatment. There were successfully obtained hollow spaced pistons of substantially the same quality, dimension, and shape as above.

EXAMPLE 2

Figure 8:
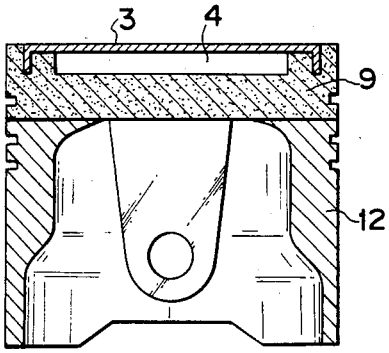
FIG. 8 is an axial cross-sectional view of another example of the heat insulating piston manufactured by the method of one embodiment of the present invention.
Figure 9A:
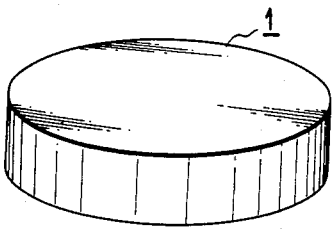
FIGS. 9A and 9B are perspective and cross sectional views of a porous member used in the manufacture of the piston of FIG. 8, respectively.
Figure 9B:
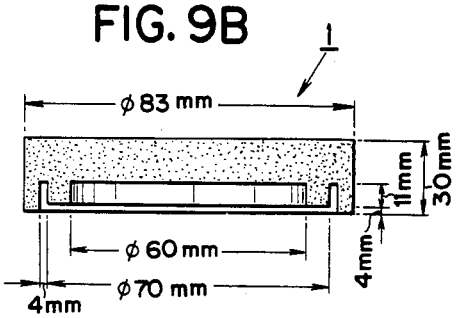
Figure 10:
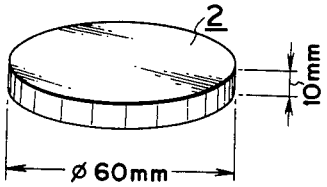
FIG. 10 is a perspective view of a precursory member in the from of a molded epoxy resin used in the manufacture of the piston of FIG. 8.
Figure 11A:
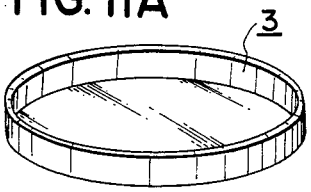
FIGS. 11A and 11B are perspective and cross sectional views of a head member used in the manufacture of the piston of FIG. 8.
Figure 11B:
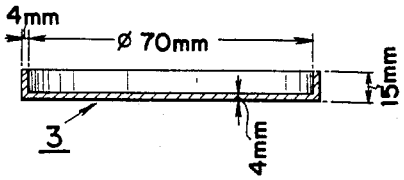
Figure 12:
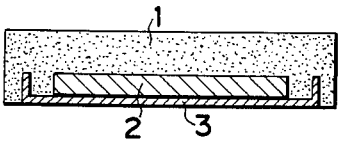
FIG. 12 is a cross sectional view of an assembly of the members of FIGS. 9, 10, and 11.
Figure 13:
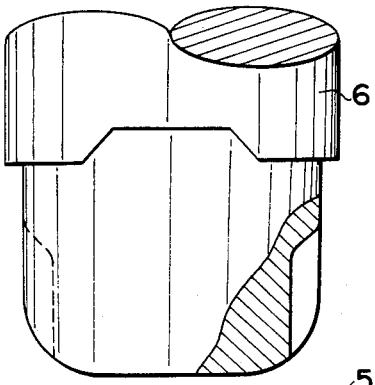
FIG. 13 schematically illustrates the pouring of molten matrix metal into a mold in the manufacture of the piston of FIG. 8.
Figure 13:
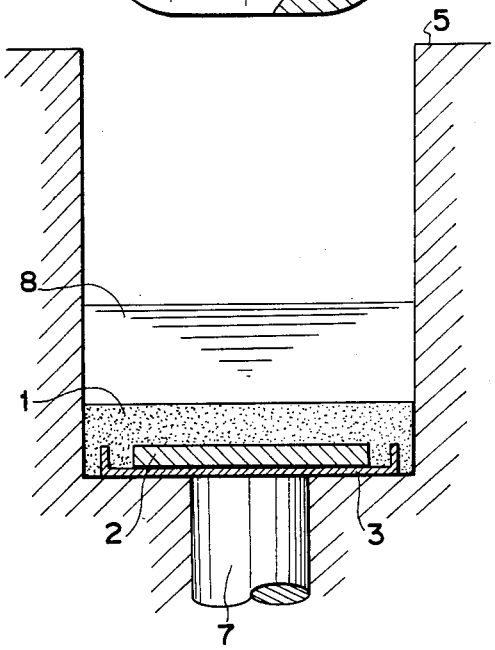

A heat insulating piston as shown in FIG. 8 was manufactured by preparing the porous member 1 in the form of a molded part of stainless steel short fibers shaped and dimensioned as shown in FIGS. 9A and 9B, the precursory member 2 in the form of a disk of an epoxy resin shaped and dimensioned as shown in FIG. 10, and the head member 3 in the form of a circular tray of SUS 304 stainless steel shaped and dimensioned as shown in FIGS. 11A and 11B. These members were combined into an assembly as shown in FIG. 12, and the assembly placed in a high pressure casting mold 5 as shown in FIG. 13. Thereafter, the same procedures as in Example 1 were repeated to produce a piston formed from JIS AC8A alloy as the matrix metal. The stainless steel fiber molded part used herein was prepared from stainless steel short fibers of 44 $\mu$m$\times$55 $\mu$m$\times$3 mm to a bulk density of 2.36 g/cm$^3$. There was obtained a heat insulating piston in which a cavity 4 substantially conforming to the original shape and dimensions of the precursory member 2 was left as a result of decomposition and gasification of the epoxy resin.

EXAMPLE 3

A heat insulating piston as shown in FIG. 1 was manufactured by preparing a porous member 1, a precursory member 2, and a head member 3 having shapes as shown in FIGS. 2 to 4. The porous member 1 and the head member 3 used were of the same materials and dimensions as used in Example 1. The precursory member 2 was formed from a low melting metal, lead (Pb) to the same diameter and thickness as in Example 1.

These members were combined as shown in FIG. 5 and the assembly placed in a mold 5 as shown in FIG. 6. A molten aluminum alloy was poured to achieve pressure casting under the same conditions as in Example 1. After solidification, the casting was removed and drilled with a passage 10 having a diameter of 3 mm as shown in FIG. 7. With the passage 10 directed downward open as in FIG. 7, the casting was subjected to a T7 heat treatment under the same conditions as in Example 1. The heat treated casting was observed to find that the lead of the precursory member had completely melted and flowed away and that a cavity substantially conforming to the original shape and dimensions of the precursory member was left within the piston body.

The casting was then machined to piston contour and the passage 10 was plugged with a stainless steel screw 11, finally obtaining a heat insulating piston as shown in FIG. 1.

A series of pistons were manufactured by the same procedure under the same conditions as above using instead of the lead, other low melting materials having a lower melting point than the aluminum alloy, bismuth (Bi), tin (Sn), and zinc (Zn) and thermoplastic resins, polycarbonate and PBT as the precursory member.

These attempts were successful in obtaining hollow spaced pistons of substantially the same quality, dimension, and shape as above.

EXAMPLE 4

A heat insulating piston as shown in FIG. 8 was manufactured by preparing the porous member 1 in the form of a molded part of stainless steel short fibers shaped and dimensioned as shown in FIGS. 9A and 9B, the precursory member 2 in the form of a disk of a low melting metal, lead shaped and dimensioned as shown in FIG. 10, and the head member 3 in the form of a circular tray of SUS 304 stainless steel shaped and dimensioned as shown in FIGS. 11A and 11B. These members were combined as shown in FIG. 12, and the assembly placed in a high pressure casting mold 5 as shown in FIG. 13. The same subsequent procedures as in Example 1 were repeated to produce a piston formed from JIS AC8A alloy as the matrix metal. The stainless steel fiber molded part used herein was prepared from stainless steel short fibers of 44 $\mu m \times 55$ $\mu m \times 3$ mm to a bulk density of 2.36 g/cm$^3$. There was obtained a heat insulating piston in which a cavity 4 substantially conforming to the original shape and dimensions of the precursory member 2 was left as a result of melting and escape of the lead.

The heat insulating pistons manufactured in Examples 1 to 4 were found to exhibit a very high degree of bond between the head member and the matrix metal, good heat insulation, and good durability because of the reinforced composite structure around the cavity. The pistons were subjected to a combustion performance test wherein the time and amount of generation of incomplete combustion gases or smoke were apparently reduced over a period from the start to a high load operation as compared with a conventional aluminum alloy piston free of a heat insulating air space. The present pistons were thus found very suitable for use in Diesel engines.

EXAMPLE 5

Figure 28:
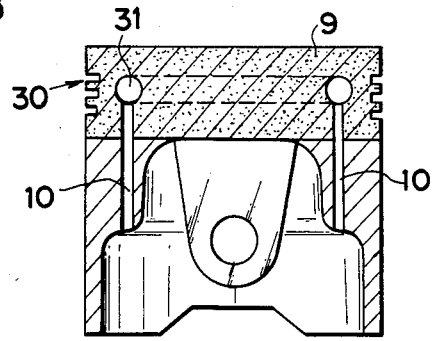
FIG. 28 is an axial cross-sectional view of a piston having a cavity for passing cooling oil inside the grooved side wall.
Figure 29A:
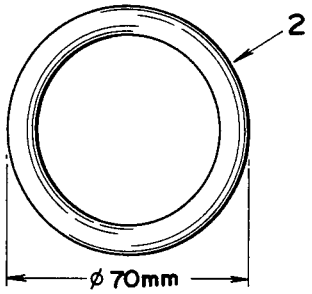
FIGS. 29A and 29B are plan and cross-sectional views of a precursory member used in the manufacture of the piston of FIG. 28.
Figure 29B:
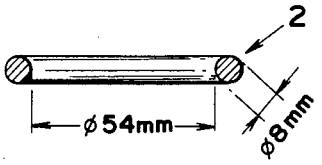

This example illustrates the manufacture of a piston having a cavity in the form of a cooling oil channel 31 extending circumferentially and inside ring grooves 30 as shown in FIG. 28. A precursory member 2 used was a ring of epoxy resin having a shape and dimensions as shown in FIGS. 29A and 29B. A porous member 1 used was a pair of diskshaped alumina short fiber molded bodies each having an annular recess 32 for receiving the precursory member 2 therein and having a bulk density of 0.17 g/cm$^3$.

Figure 30:
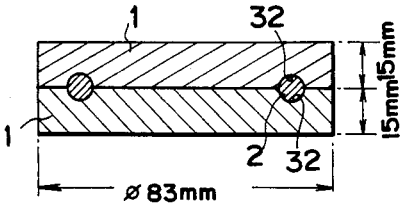
FIG. 30 is a cross-sectional view of an assembly of the precursory member of FIG. 29 and a porous member used in the manufacture of the piston of FIG. 28.
Figure 31:
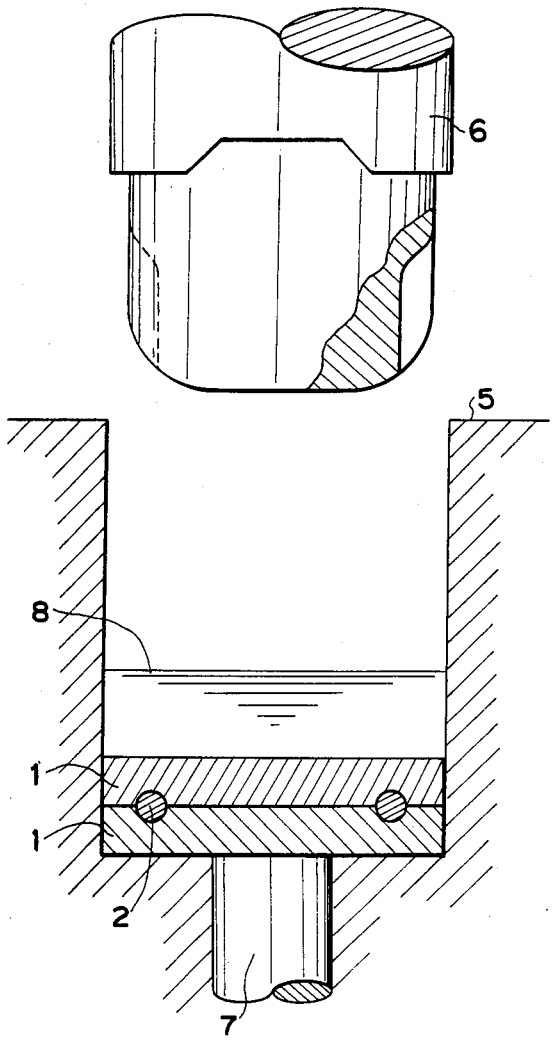
FIG. 31 schematically illustrates the pouring of molten matrix metal into a mold in the manufacture of the piston of FIG. 28.
Figure 32:
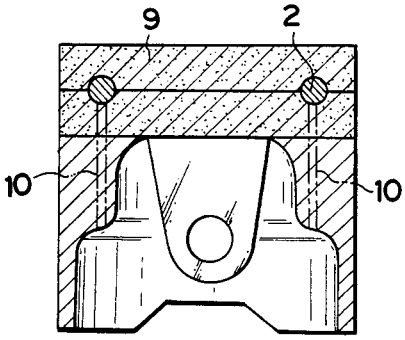
FIG. 32 is an axial cross-sectional view of the piston casting after being taken out of the mold of FIG. 31 and before removal of the precursory member therefrom.

These members were combined into an assembly as shown in FIG. 30. The assembly was placed in a mold 5 as shown in FIG. 31. A melt 8 of an aluminum alloy (JIS AC8A, Al-12%S;-1.2%Cu-1.0%Mg-2%Ni-0.3%Fe) at a temperature of 720° C. was cast into the mold cavity, and then forced under a pressure of 500 kg/cm$^2$ by a pressing punch 6 to accomplish high pressure casting. The pressing force was maintained until the molten aluminum alloy had completely solidified. After solidification, the casting was taken out of the mold and machined to form vents or passages 10 having a diameter of 3 mm for gas venting as shown in FIG. 32. The casting was subjected to a T7 heat treatment including a solution heat treatment at 490° C. for 4 hours and an aging treatment at 220° C. for 8 hours. The heat treated casting was observed to find that the epoxy resin of the precursory member had been completely decomposed and gasified and that a cavity 31 substantially conforming to the original shape and dimensions of the extracted precursory member was left within the piston body. The porous member 1 was converted into a composite region with the aluminum alloy. A subsequent machining process yielded a piston as shown in FIG. 28. In this example, the passages 10 were kept open because they could serve as inlet and outlet ports for cooling oil.

EXAMPLE 6

A piston having a cooling oil channel 31 as shown in FIG. 28 was manufactured by repeating substantially the same procedure as in Example 5 except that the precursory member of epoxy resin was replaced by a precursory member of lead (Pb) having the same shape and dimensions. The cooling oil channel 31 was left after the lead of the precursory member was completely melted and removed during the T7 treatment.

Figure 14:
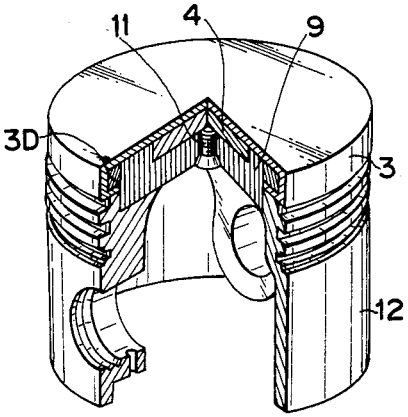
FIG. 14 is a perspective, partially cut away, view of one example of the heat insulating piston manufactured by the method of a second embodiment of the present invention.

Next, the second embodiment of the present invention will be illustrated by referring to a heat insulating piston as shown in FIG. 14, that is, a piston having a heat insulating cellular cavity 4 in the form of a porous insert just below its head surface.

As previously described for the manufacture of the heat insulating piston shown in FIG. 1, a piston as shown in FIG. 14 is likewise manufactured by previously preparing a porous member 1, a precursory member 2, and a head member 3 as shown in FIGS. 2 to 4 and combining them into an assembly as shown in FIG. 5.

The precursory member 2 is formed from a composite material wherein a material which remains in solid state at room temperature and is gasifiable through combustion, sublimation, evaporation or decomposition when heated at a temperature below the melting point of a matrix metal to be cast, for example, an aluminum alloy (to be referred to as normally solid material, hereinafter) is combined with a material which is stable at least at the gasifying temperature of the normally solid material (to be referred to as stable material, hereinafter).

The normally solid material used herein may be either an organic or inorganic material It may be chosen by taking into account the melting point of a particular matrix metal used and the ease of composite integration with the stable material. Where the matrix metal is an aluminum alloy, for example, there may be used resins such as epoxy resins and polyimide resins and rubbers such as silicone rubbers as the normally solid organic material and $SeO_2$ and $SnBr_4$ as the normally solid inorganic material. It will be understood that the normally solid materials used herein are not limited to these examples.

The stable materials which form composite bodies with the normally solid materials may be those materials which are stable at least at the gasifying temperature of the normally solid materials. For an actual choice, they are preferably stable at a temperature equal to or higher than the melting point of the matrix metal. Particularly in the case of heat insulating pistons, they are preferably stable up to a temperature higher than the piston head temperature (about 700° to 800° C.) during operation. Since the stable material eventually turns into a porous heat insulating insert, it is desirable to use a material having a low thermal conductivity. These considerations suggest that the preferred stable materials are ceramic materials such as alumina, silicon nitride, and silicon carbide, glass fibers, and metal fibers having a relatively low thermal conductivity such as stainless steel fibers. The shape of the stable material is only required to readily form a composite body with the normally solid material and become a porous body after the normally solid material is gasified and removed. Thus the stable materials may generally take any desired shapes including short fibers, long fibers, granules, box, and chips as well as cellular form. The stable materials may be used alone or in admixture of two or more.

The precursory member 2 comprising the normally solid material integrated with the stable material into a composite body is configured in a shape intended for the finally left porous heat insulating region 4, for example, a disk shape. Any well known methods may be utilized to produce the precursory member 2 by integrating and shaping the normally solid material such as a resin with the stable material such as ceramic fibers into a composite body.

The porous member 1 and the head member 3 may be made of the same materials as previously described.

These members are combined into an assembly as shown in FIG. 5. The assembly is set in place in a mold 5 as shown in FIG. 6. A molten matrix metal, for example, molten aluminum alloy is the cast into the mold cavity. At this point of time, the molten matrix metal does not make a direct access to the precursory member 2 of composite material, and thus the normally solid material in the precursory member 2 has not been gasified through combustion, sublimation, evaporation or decomposition.

The molten matrix metal is subsequently forced under pressure by means of a pressing punch 6. Under the pressure applied, the molten matrix metal infiltrates into the porous member 1 to change it into a composite region 9. At this point of time, the molten matrix metal 8 which has penetrated through pores of the porous member 1 emerges from the porous member 1 to contact the precursory member 2 covered with the porous member, and the normally solid material of the composite material of precursory member 2 can thus be partially gasified at contact sites. However, the rapid cooling and solidification of the molten matrix metal with the aid of the pressing force as previously described prohibits dispersion of evolving gases into the casting matrix metal, preventing occurrence of casting defects. The composite material precursory member 2 is little impregnated with the molten matrix metal. The magnitude of the pressing force is not particularly limited although it is preferably at least about 300 kg/cm$^2$ for the same reason as previously described.

The solidified piston casting is taken out of the mold 5. As shown in FIG. 7, the porous member 1 has formed the composite region 9 with the matrix metal and the casting has the precursory member 2 and the head member 3 embedded in the solidified matrix metal 12, for example, aluminum alloy. The piston casting is then perforated with a passage 10 which extends throughout the composite region 9 in communication with the precursory member 2 before the casting is heated at a temperature below the melting point of the matrix metal and above the gasifying temperature (that is, combustion, sublimation, evaporation, or decomposition temperature) of the normally solid material of the precursory member 2. Then the normally solid material of the precursory member 2 is gasified to flow away through the passage 10, forming a porous heat insulating insert 4 consisting of the stable material in which voids are left where the normally solid material has been extracted.

Thereafter, the casting may be machined if necessary and the passage 10 is closed with a plug, for example, a screw 11, obtaining a heat insulating piston as shown in FIG. 14.

When automotive pistons are manufactured by aluminum alloy casting, it is a common practice to effect a T7 heat treatment at the end of casting. Since the heat applied in the T7 treatment is sufficient to remove the normally solid material of the precursory member 2 through gasification, any particular separate heating other than the T7 treatment is not necessary for material removal.

In the thus manufactured heat insulating piston as shown in FIG. 14, the head is constituted by the head member 3 of heat resistant metal, the porous insert 4 is formed just below the head for containing heat insulating air, and the peripheral and lower sides of the insert 4 are reinforced by the metal/porous material composite region 9.

It will be understood that the molten matrix metal 8 penetrates through the porous member 1 to enter a region 3D defined by the peripheral folded portions 3B and 3C of the head member 3. The head member 3 is firmly supported in the region 3D too.

Figure 15:
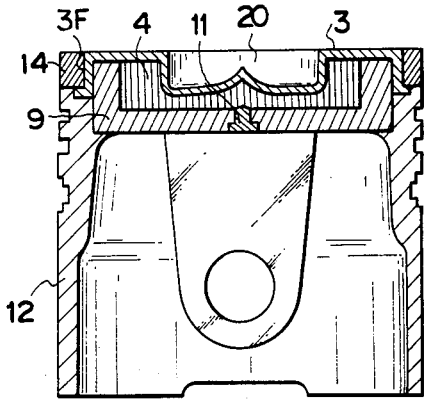
FIG. 15 is an axial cross-sectional view of another example of the heat insulating piston manufactured by the method of a second embodiment of the present invention.
Figure 16A:
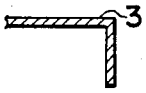
FIGS. 16A through 16I illustrate different folded shapes applicable to the pheripheral portion of the head member used in the manufacture of a piston according to the present method.
Figure 16B:
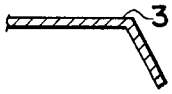
Figure 16C:
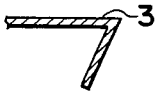
Figure 16D:
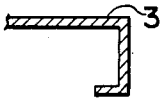
Figure 16E:
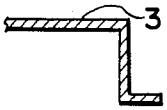
Figure 16F:
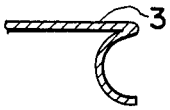
Figure 16G:
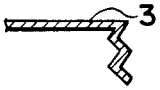
Figure 16H:
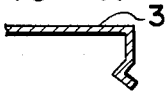
Figure 16I:
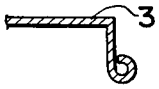
Figure 17A:
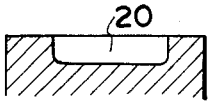
FIGS. 17A through 17D illustrate different shapes of the head of the piston manufactured by the present method.
Figure 17B:
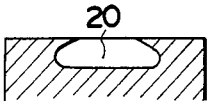
Figure 17C:
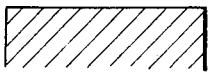
Figure 17D:
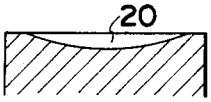
Figure 18A:
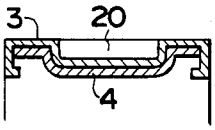
FIGS. 18A through 18D illustrate different arrangements of the cellular heat insulating cavity in the piston manufactured by the present method.
Figure 18B:
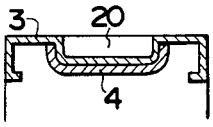
Figure 18C:
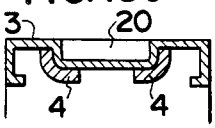
Figure 18D:
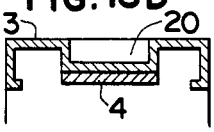

FIG. 15 shows another example of the piston casting manufactured by the method of the second embodiment of the present invention. The piston illustrated has a head formed by a head member 3 of heat resisting metal which is provided with a combustion chamber recess 20. The head member 3 has a folded peripheral portion 3F embedded in the matrix metal. The piston head thus has a peripheral portion 14 surrounding the folded portion 3F. This head peripheral portion 14 is formed of the same composite material as that of the composite material region 9 covering the porous insert or heat insulating insert 4. The piston head peripheral portion or composite region 14 is produced likewise the composite material region 9 by the infiltration of ceramic fibers with the molten matrix metal during pressure forcing as will be demonstrated in Example 7. Since the pheripheral portion 3F of the piston head member 3 is surrounded by the matrix metal, the head member 3 is firmly bonded and retained by the matrix metal 12. The presence of the piston head peripheral portion 14 of composite material is only a result of the fact that when the head member 3 is placed in a mold, a porous ring of alumina short fibers, for example, is disposed around the folded peripheral portion 3F of the head member 3 to precisely position the peripheral portion. The head peripheral portion 14 need not necessarily be of composite material.

The bond between the head member 3 and the matrix metal 12 is strengthened by folding the peripheral portion 3F of the head member 3 in a direction away from the head surface and embedding the folded portion in the matrix metal. To achieve such a firm bond, the peripheral portion of the head member 3 may have any of various shapes as shown in FIGS. 16A to 16I.

The shape of the piston head, that is, the shape of the head member 3 having the recess 20 may be selected from various shapes as shown in FIGS. 17A to 17D.

The porous insert or heat insulating region 4 formed just below the piston head is required to correspond to a zone of the piston head surface where the maximum temperature is reached and be thus formed adjacent the rear surface of the head member 3 in said zone. In addition to the configurations shown in FIGS. 14 and 15, the porous insert 4 may take any of various arrangements as shown in FIGS. 18A to 18D.

The foregoing method for manufacturing a piston having a cellular cavity within its head is also applicable to the manufacture of a piston having a cellular cavity for passing cooling oil inside the side wall where piston rings are fitted. In this case, the head member is generally unnecessary. The passages for removal of the gasifiable material may be later used as inlet and outlet ports for cooling oil.

EXAMPLE 7

Figure 19:
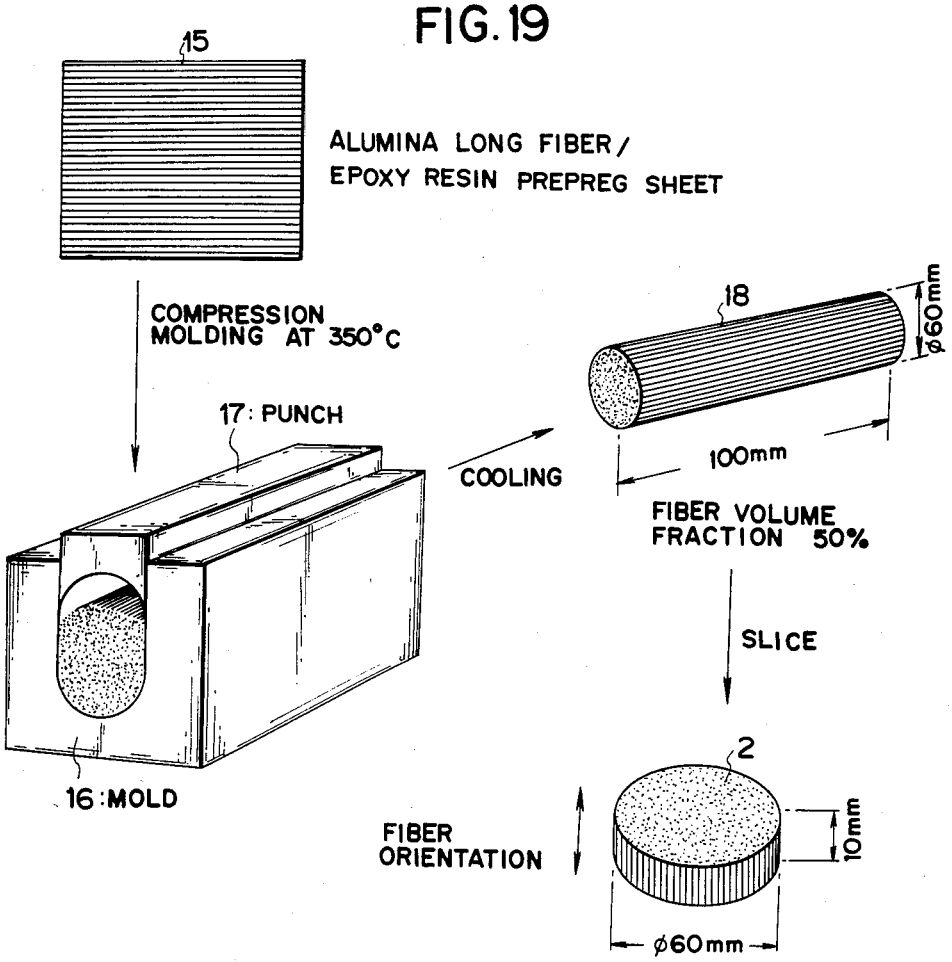
FIG. 19 illustrates a process of preparing a composite material into a precursory member for forming a cellular cavity.

A heat insulating piston having a porous heat insulating insert 4 just below its head as shown in FIG. 14 was manufactured by preparing a porous member 1, a precursory member 2, and a head member 3 having shapes as shown in FIGS. 2 to 4. The porous member 1 was molded from alumina short fibers to a bulk density of 0.17 g/cm$^3$ and dimensioned to an outer diameter of 70.2 mm, an entire thickness of 30 mm, a recess 1A diameter of 60 mm, and a recess 1A depth of 10 mm. The precursory member 2 was made from a composite material of an epoxy resin as the normally solid material and alumina long fibers (diameter 20 $\mu$m) as the stable material. As shown in FIG. 19, a prepreg sheet 15 formed from an epoxy resin and alumina long fibers was compression molded at 350° C. in a mold 16 with the aid of a punch 17 into an FRP cylinder 18 having a diameter of 60 mm and a length of 100 mm which was cooled and sliced into disks of 10 mm thick. There was obtained a disk-shaped precursory member 2 having a diameter of 60 mm and a thickness of 10 mm. The head member 3 was prepared from an SUS 304 stainless steel strip of 4 mm thick by hydraulic forming and dimensioned to an outer diameter of 83 mm, a height of 15 mm, and a peripheral portion 3C opening diameter of 70 mm.

These members were combined into an assembly as shown in FIG. 5. The assembly was placed in a mold 5 as shown in FIG. 6. A melt 8 of an aluminum alloy (JIS AC8A, Al-12%Si-1.2%Cu-1.0%Mg-2%Ni-0.3%Fe) at a temperature of 720° C. was then cast into the mold cavity, and forced under a pressure of 500 kg/cm$^2$ by a pressing punch 6 to accomplish high pressure casting. The pressing force was maintained until the molten aluminum alloy had completely solidified. After solidification, the casting was taken out of the mold and machined to form a vent or passage 10 having a diameter of 3 mm for gas venting as shown in FIG. 7. The casting was subjected to a T7 heat treatment including a solution heat treatment at 490° C. for 4 hours and an aging treatment at 220° C. for 8 hours. The heat treated casting was observed to find that the epoxy resin (normally solid material) of the precursory member had been completely decomposed and gasified and that a porous insert of alumina long fibers having a porosity of 50% was formed within the piston body.

The casting was then machined to a piston contour and the passage 10 was plugged with a stainless steel screw 11, finally obtaining a heat insulating piston as shown in FIG. 14.

Another piston was manufactured by the same procedure under the same conditions as above except that an FRP disk of polyimide fibers and E-glass long fibers (diameter 13 $\mu$m) was used as the precursory member. The FRP disk used was prepared by comminuting a prepreg sheet of polyimide fibers and E-glass long fibers into chops of about 5 mm long, and compression molding the chops at 250° C. into a disk having fibers randomly oriented. The disk had a diameter of 60 mm, a thickness of 10 mm, and a fiber volume proportion of 40%.

There was obtained a piston of substantially the same quality, dimension, and shape as above. The porous insert or heat insulating region 4 of the piston had a porosity of 60%.

A further piston was manufactured by the same procedure under the same conditions as above except that a silicone rubber was used instead of the epoxy resin as the normally solid material of the composite material of which the precursory member 2 was made. That is, an precursory member formed of a composite material of silicone rubber and alumina long fibers was used. There was obtained a piston having a porous heat insulating insert 4 and substantially the same quality, dimension, and shape as above. When $SeO_2$ and $SnBr_4$ were used instead of the epoxy resin as the normally solid material of the composite material from which the precursory member 2 was made, it was found that the former sublimated and the latter evaporated during the T7 heat treatment. There were successfully obtained pistons having a porous heat insulating insert 4 and substantially the same quality, dimension, and shape as above.

EXAMPLE 8

Figure 20:
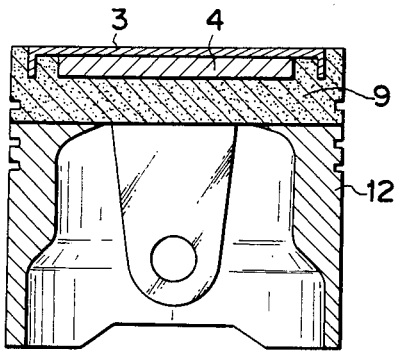
FIG. 20 is an axial cross-sectional view of a further example of the heat insulating piston manufactured by the method of a second embodiment of the present invention.

A heat insulating piston as shown in FIG. 20 was manufactured by preparing the porous member 1 in the form of a molded part of stainless steel short fibers shaped and dimensioned as shown in FIGS. 9A and 9B, the precursory member 2 in the form of a disk of an FRP (alumina long fibers/epoxy resin composite material) shaped and dimensioned as shown in FIG. 10, and the head member 3 in the form of a circular tray of SUS 304 stainless steel shaped and dimensioned as shown in FIGS. 11A and 11B. These members were combined as shown in FIG. 12, and the assembly placed in a high pressure casting mold 5 as shown in FIG. 13. Thereafter, the same procedures as in Example 1 were repeated to produce a piston formed from JIS AC8A alloy as the matrix metal. The stainless steel fiber molded part used herein was prepared from stainless steel short fibers of 44 $\mu$m$\times$55 $\mu$m$\times$3 mm to a bulk density of 2.36 g/cm$^3$. There was obtained a heat insulating piston in which a porous insert 4 substantially conforming to the original shape and dimensions of the precursory member 2 was formed as shown in FIG. 20.

The heat insulating pistons manufactured in Examples 7 and 8 were found to exhibit a very high degree of bond between the head member and the matrix metal, good heat insulation, and good durability because of the reinforced composite structure around the porous insert. The pistons were subjected to a combustion performance test wherein the time and amount of generation of incomplete combustion gases or smoke were apparently reduced over a period from the start to a high load operation as compared with a conventional aluminum alloy piston free of heat insulation. The present pistons were thus found very suitable for use in Diesel engines.

For comparison purposes, pistons were manufactured by repeating the procedure of Example 1 wherein a precursory member 2 formed of an epoxy resin alone was used to form a cavity; and by repeating the procedure of Example 7 wherein a precursory member was used to form a porous heat insulating insert, both using head members 3 of 2 mm and 4 mm thick. These pistons were subjected to a continuous durability test by assembling them in a Diesel engine and continuously operating the engine at a high load of 4,400 rpm for 50 hours. The piston heads were examined for durability. Among the hollow spaced heat insulating pistons according to Example 1, one having a head member of 4 mm thick showed no perceivable deformation, but one having a head member of 2 mm thick was deformed at the head due to the heat and pressure of combustion. No deformation was observed on the head of the pistons having the heat insulating porous insert according to Example 7 irrespective of whether the head members were 2 mm or 4 mm thick.

As evident from these results, the pistons having the heat insulating porous insert allows the use of a head member of a reduced thickness as compared with the pistons having a heat insulating cavity. The former pistons have the advantages of light weight and cost reduction. We have made some pistons using commercially available materials. When a piston having a heat insulating cavity according to Example 1 was prepared using a head member of SUS 304 of 4 mm thick and an aluminum alloy as the matrix metal, it weighed 755 grams. When a piston having a heat insulating porous insert according to Example 5 was prepared using a head member of SUS 304 of 2 mm thick and an aluminum alloy as the matrix metal, it weighed 572 grams. The use of a heating insulating porous insert gained an about 24% weight reduction, which is of significance for improvements in engine performance and fuel consumption.

EXAMPLE 9

Figure 21:
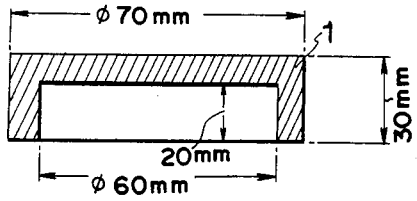
FIG. 21 is a cross section of a porous member used in the manufacture of the piston of FIG. 15.
Figure 22:
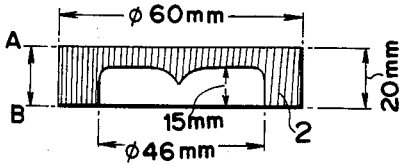
FIG. 22 is a cross section of a precursory member of composite material used in the manufacture of the piston of FIG. 15.
Figure 23:
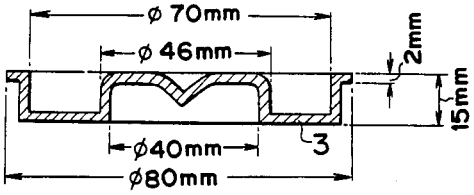
FIG. 23 is a cross section of a head member used in the manufacture of the piston of FIG. 15.
Figure 24:
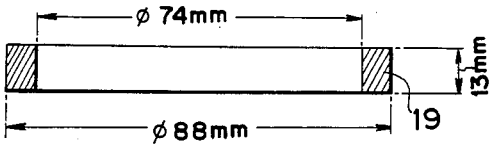
FIG. 24 is a cross section of a porous ring to be disposed about the head member in the manufacture of the piston of FIG. 15.
Figure 25:
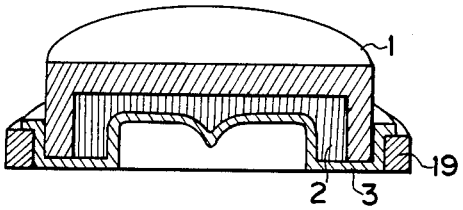
FIG. 25 is a cross sectional view of an assembly of the members of FIGS. 21, 22, 23, and 24.
Figure 26:
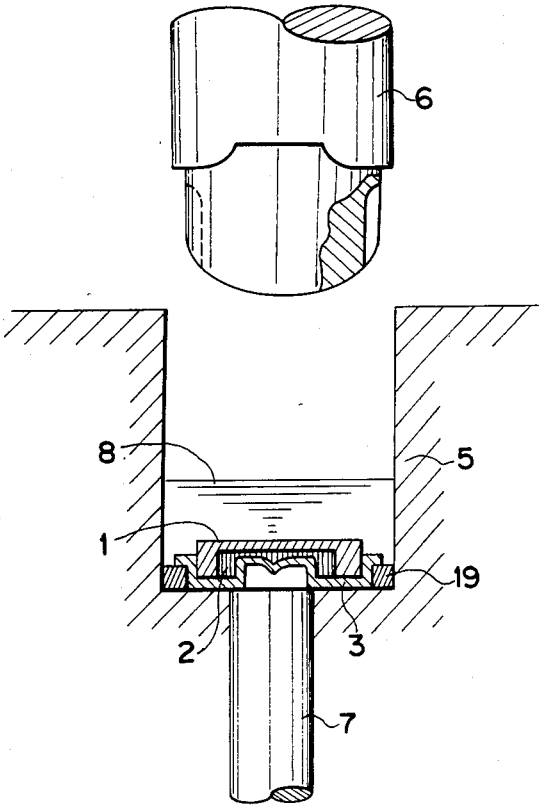
FIG. 26 schematically illustrates the pouring of molten matrix metal into a mold in the manufacture of the piston of FIG. 15.

A heat insulating piston as shown in FIG. 15 was manufactured by preparing a porous member 1 in the form of a molded part of alumina short fibers shaped and dimensioned as shown in FIG. 21 (fiber diameter 3 μm, fiber length 3 mm, bulk density 0.17 g/cm$^3$), a precursory member 2 in the form of an FRP molded from a composite material of alumina long fibers (diameter 20 μm) and epoxy resin to a shape as shown in FIG. 22 (fibers oriented in a thickness direction, fiber volume fraction 50%), a head member 3 fabricated from an SUS 304 stainless steel strip of 2 mm thick to a shape as shown in FIG. 23, and a porous ring 19 in the form of a molded part of alumina short fibers shaped and dimensioned as shown in FIG. 24. These members were combined into an assembly as shown in FIG. 25 wherein the precursory member 2 was placed on the head member 3 to mate with its recess and covered with the porous member 1, and the porous ring 19 placed around the head member 3 adjacent its folded peripheral portion. The assembly was placed in a pressure casting mold 5 as shown in FIG. 26, a melt of aluminum alloy with designation JIS AC8A at a temperature of 720° C. was poured into the mold cavity and forced under a pressure of 500 kg/cm$^2$. As a result of high pressure casting, a piston casting was obtained having the head member 3 of stainless steeel and the precursory member 2 of FRP embedded in its head.

Figure 27:
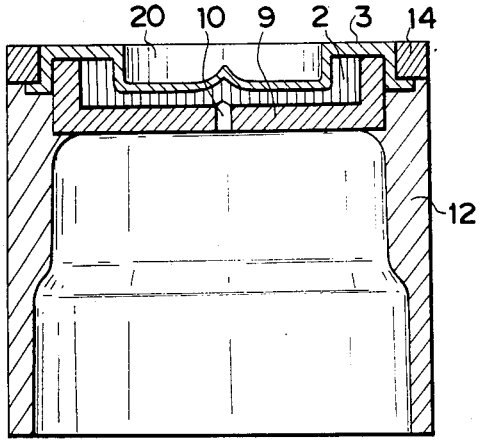
FIG. 27 is an axial cross-sectional view of a piston as cast in the manufacture of the piston of FIG. 15.

The casting was drilled with a passage 10 having a diameter of 3 mm and extending to the precursory member 2 as shown in FIG. 27. The casting was subjected to a T7 heat treatment including a solution heat treatment at 490° C. for 3 hours and an aging treatment at 220° C. for 6 hours. The piston matrix metal, aluminum alloy was heat treated and the epoxy resin moiety of the FRP was burned and removed to leave a porous heat insulating insert 4. Thereafter, the piston casting was further machined to form piston ring grooves and the passage 10 was plugged with a stainless steel screw, finally obtaining a heat insulating piston having a porous heat insulating insert 4 of alumina long fibers as shown in FIG. 15. In this example, the piston head peripheral portion 14 was also comprised of a composite material of alumina short fibers and aluminum alloy matrix metal.

The pistons were mounted in a Diesel engine and subjected to a combustion performance test wherein the time and amount of generation of incomplete combustion gases or smoke were apparently reduced and the fuel consumption was improved over a period from the start to a high load operation as compared with a conventional aluminum alloy piston.

Another piston was manufactured by repeating the procedure of Example 9 except that the FRP used as the composite material of the precursory member 2 was replaced by a composite material of SiC particles and an epoxy resin having a silicon carbide volume fraction of 60%. The resulting piston had a porous heat insulating insert 4 of silicon carbide particles formed just below its head. Further, the procedure of Example 7 was repeated using a composite material of a cellular $SiO_2$-$Al_2O_3$ foam having a volume ratio of 40% and impregnated with epoxy resin. There was obtained a piston having a porous heat insulating insert of foam structure. Likewise the piston having a porous heat insulating insert of alumina long fibers, these pistons were found to exhibit excellent combustion properties when combined with Diesel engines.

EXAMPLE 10

A piston having, instead of the cooling oil channel 31 shown in FIG. 28, a cooling oil channel in the form of a cellular cavity was produced. The procedure of Example 5 was repeated except that the precursory member of epoxy resin used in Example 5 was replaced by a ring-shaped precursory member which was prepared from a fiber reinforced plastic material of alumina long fibers bound in epoxy resin to the same shape and dimensions. In the ring-shaped precursory member of fiber reinforced plastic material, fibers were oriented in a circumferential direction of the ring. A cooling oil channel in the form of a cellular cavity was obtained after the epoxy resin of the fiber-reinforced plastic material had been completely gasified and removed.

As demonstrated in the foregoing examples, the method of the present invention allows for the easy and convenient manufacture of a piston having an empty or cellular cavity within its head. At the same time as the cavity is formed, its surrounding is reinforced by the formation of a composite structure of porous material and matrix metal. When the present method is applied to the manufacture of a heat insulating piston, the head where the maximum temperature is reached during operation is formed by a head member of heat resistant metal, and a heat insulation air layer is located just below the head to prevent the heat of the combustion chamber from escaping to the exterior through the piston, thus helping the combustion chamber to remain hot, which leads to improvements in fuel consumption and power of the engine, as well as preventing incomplete combustion at an initial period from the engine start. When the present method is applied to the manufacture of a piston having a cooling oil channel inside the grooved side wall where piston rings are fitted, the side wall of the piston exhibits improved wear resistance because it is cooled with circulating oil to prevent excessive heating.

We claim:

1. A method for producing a piston of a light alloy matrix metal having a cavity within its head by pressure casting, comprising the steps of:

preforming a precursory member having the shape of said cavity from an extractable material which remains in solid state at room temperature and is convertible into a fluid at a heating temperature below the melting point of the matrix metal, disposing said precursory member in place in a pressure casting mold having a cavity corresponding to the shape of the piston, while covering said precursory member with a porous member stable to molten matrix metal, pouring molten matrix metal into the mold cavity and applying a pressure thereto to form a piston-shaped casting having said precursory member and said porous member embedded therein, and heating said casting at a temperature below the melting point of said matrix metal and above the fluidizing temperature of the material of said precursory member to convert the precursory member material into a fluid, and extracting said fluid from said casting, leaving a cavity at the location of said precursory member.

2. A method according to claim 1 wherein in the pressure casting step, said porous member is impregnated with the molten matrix metal to form a composite region.

3. A method according to claim 1 wherein said matrix light alloy comprises an aluminum alloy.

4. A method according to claim 1 wherein said porous member is formed of a material having a melting point higher than the pouring temperature of the molten matrix metal.

5. A method according to claim 1 wherein said porous member comprises a porous ceramic or metal member.

6. A method according to claim 1 wherein the cavity is located immediately below the head surface and serves for air heat insulation.

7. A method according to claim 1 wherein the cavity is located immediately inside the side wall of the piston where a piston ring groove is to be formed and serves for channelling cooling oil.

8. A method according to claim 1 which further comprising forming a passage in the casting for providing a communication from the exterior of the casting remote from the head to said precursory member after the casting step and before the heating step, the fluidized material of the precursory member being extracted through said passage in the heating step.

9. A method according to claim 8 which further comprising blocking said passage with a plug member after the precursory member material has been extracted.

10. A method according to claim 1 wherein the extractable material from which said precursory member is preformed comprises a gasifiable material which remains in solid state at room temperature and is gasifiable at a heating temperature below the melting point of the matrix metal, and in the heating step, said casting is heated to a sufficient temperature to gasify the gasifiable material into gases which are flowed out of said casting to remove said precursory member.

11. A method according to claim 10 wherein the material is gasified through combustion, sublimation, evaporation, or decomposition.

12. A method according to claim 10 wherein the gasifiable material from which said precursory member is preformed comprises at least one material selected from synthetic resins, wood, rubbers, and low sublimation temperature inorganic compounds.

13. A method according to claim 1 wherein the extractable material from which said precursory member is preformed comprises a low melting material which remains in solid state at room temperature and melts at a heating temperature below the melting point of the matrix metal, and in the heating step, said casting is heated to a sufficient temperature to melt the low melting material into a liquid which is flowed out of said casting to remove said precursory member.

14. A method according to claim 13 wherein the low melting material from which said precursory member is preformed is selected from thermoplastic resins, inorganic compounds, and metals.

15. A method according to claim 14 wherein the low melting material from which said precursory member is preformed comprises a metal which separates from the matrix metal as a separate phase in liquid state.

16. A method according to claim 6 wherein said disposing step further includes disposing a head member of heat resisting metal material to constitute at least a portion of the piston head on the bottom of the pressure casting mold cavity, disposing said precursory member on the inside of said head member, and disposing said porous member stable to molten matrix metal thereon to cover said precursory member.

17. A method according to claim 16 wherein said head member has a peripheral portion of a shape bent with respect to the finally obtained head surface of the piston and at least the edge of the bent peripheral portion is embedded in the matrix metal during the pressure casting step.

18. A method for producing a piston of a light alloy matrix metal having a cellular cavity within its head by pressure casting, comprising the steps of:

preforming a precursory member having the shape of said cavity from a composite material comprising a normally solid material which remains in solid state at room temperature and is gasifiable at a heating temperature below the melting point of the matrix metal and a material integrated therewith and stable at least at the gasifying temperature of the normally solid material, disposing said precursory member in place in a pressure casting mold having a cavity corresponding to the shape of the piston, while covering said precursory member with a porous member stable to molten matrix metal, pouring molten matrix metal into the mold cavity and applying a pressure thereto to form a piston-shaped casting having a head member, said precursory member, and said porous member embedded therein, and heating said casting at a temperature below the melting point of said matrix metal and above the gasifying temperature of the normally solid material of said precursory member to gasify the normally solid material, and extracting the resulting gases from said casting, thereby converting said precursory member into the cellular cavity.

19. A method according to claim 18 wherein in the pressure casting step, said porous member is impregnated with the molten matrix metal to form a composite region.

20. A method according to claim 18 wherein said matrix light alloy comprises an aluminum alloy.

21. A method according to claim 18 wherein the normally solid material is gasified through combustion, sublimation, evaporation, or decomposition.

22. A method according to claim 18 wherein the normally solid material comprises at least one material selected from synthetic resins, wood, rubbers, and low sublimation temperature inorganic compounds.

23. A method according to claim 18 which further comprising forming a passage in the casting for providing a communication from the exterior of the casting to said precursory member after the casting step and before the heating step, the gasified product of the normally solid material of the precursory member being extracted through said passage in the heating step.

24. A method according to claim 23 which further comprising blocking said passage with a plug member after the normally solid material of the precursory member has been extracted.

* * * * *